US008402866B2

(12) United States Patent
Hu

(10) Patent No.: US 8,402,866 B2
(45) Date of Patent: Mar. 26, 2013

(54) OPEN END WRENCH CAPABLE OF FAST DRIVING

(76) Inventor: Bobby Hu, Taichung (TW)

( * ) Notice: Subject to any disclaimer, the term of this patent is extended or adjusted under 35 U.S.C. 154(b) by 386 days.

(21) Appl. No.: 12/890,767

(22) Filed: Sep. 27, 2010

(65) Prior Publication Data

US 2011/0265613 A1 Nov. 3, 2011

(30) Foreign Application Priority Data

Apr. 30, 2010 (TW) ..... 99113946 A

(51) Int. Cl.
*B25B 13/12* (2006.01)
*B25B 13/46* (2006.01)
*B25B 13/28* (2006.01)
*B25B 13/00* (2006.01)

(52) U.S. Cl. ..... 81/179; 81/63; 81/92; 81/186; 81/94

(58) Field of Classification Search ..... 81/179, 81/63, 92, 186, 94
See application file for complete search history.

(56) References Cited

U.S. PATENT DOCUMENTS 1,320,668 A 11/1919 Askman
3,695,125 A 10/1972 Glass et al.
4,706,528 A 11/1987 Inoue
7,024,971 B2 4/2006 Stanton
7,827,887 B2 * 11/2010 Lee ..... 81/179
2009/0301271 A1 * 12/2009 Tuan-Mu et al. ..... 81/179
2010/0071516 A1 3/2010 Wu

* cited by examiner

*Primary Examiner* — Monica Carter
*Assistant Examiner* — Danny Hong
(74) *Attorney, Agent, or Firm* — Alan Kamrath; Kamrath IP Lawfirm, P.A.

(57) ABSTRACT

An open end wrench (10) includes first and second jaws (23, 24) formed on a jaw portion (22). The first jaw (23) includes an arcuate sliding groove (27) having two support walls (272, 273) and an arcuate sliding wall (271) between the support walls (272, 273). A slide (30) is received in the sliding groove (27) and includes an arcuate sliding face (31) slideable along the sliding wall (272). An arcuate guiding slot (35) is formed in the slide (30). A guide (28) is fixed in the sliding groove (27) and received in the guiding slot (35). The guiding slot (35) includes a pressing end (352). An elastic device (40) has two ends respectively abutting the guide (28) and the pressing end (352) of the guiding slot (35) for biasing the slide (30) to a natural position. The slide (30) includes a first wrenching face (32) having two wings (36). A spacing (L) is formed between each wings (36) and one of the support walls (272, 273).

13 Claims, 12 Drawing Sheets

A-A

OPEN END WRENCH CAPABLE OF FAST DRIVING

BACKGROUND OF THE INVENTION

The present invention relates to an open end wrench capable of fast driving and, more particularly, to an open end wrench capable of fast driving a workpiece without the risk of undesired shifting from the workpiece.

U.S. Pat. No. 1,320,668 discloses a wrench including a stationary jaw and a movable jaw slideable along a guide. The movable jaw is forced against an abutment at an outer end of the guide by a spring bearing against the stationary jaw. An end of the spring is received in a bore in the stationary jaw. The other end of the spring is received in another bore in the movable jaw. An intermediate portion of the spring is exposed between the stationary jaw and the movable jaw. When the user is intended to tighten or loosen a nut, the wrench is turned in a driving direction during which operation the movable jaw remains in contact with the abutment. For reengagement of the wrench with the nut it is necessary only to turn the wrench in the opposite direction, during which operation the movable jaw slides backward against the pressure of the spring and on the edges of the nut. The movable jaw is forced forward again as soon as the bearing surfaces of the stationary and movable jaws are parallel with the sides of the nut. The nut can be tightened or loosened through repeated operations. However, the structural strength of the wrench is insufficient for high-torque operation, as the movable jaw merely encloses the guide and is not enclosed by other members. Furthermore, the guide is irregularly formed in a wrenching space of the wrench, leading to difficulties in processing. Further, the exposed portion of the spring, when compressed by the movable jaw, is liable to bend and, thus, in friction contact with the end edges of the bores of the stationary and movable jaws, leading to non-smooth compression of the spring or even permanent deformation of the spring. Further, the exposed portion of the spring is apt to be contaminated by oil to which debris easily adheres.

U.S. Pat. No. 3,695,125 discloses an open end ratchet wrench including a head having a fixed jaw and an opposed pawl support portion. A pawl and a spring are mounted to an inner side of the pawl support portion. The pawl is biased by the spring and slideable between an extended torquing position and a retracted ratcheting position. Two side caps are fixed to two sides of the head to define a space receiving the pawl and the spring and to prevent disengagement of the pawl and the spring. The pawl includes a stop shoulder to prevent the pawl from moving out of the pawl support portion under the action of the spring. The pawl support portion includes an arcuate section and then extends perpendicularly to the fixed jaw. Such a structure is difficult to process. Furthermore, assembly of the open end ratchet wrench is troublesome. Further, the pawl is merely enclosed at both sides and has insufficient structural strength in the lateral direction. Further, a contact area of the workpiece (such as a nut) engaged with the movable pawl is smaller than a contact area of the workpiece engaged with the fixed jaw. When the nut is tightened to a position adjacent to an object to be fixed, wear or damage to the nut may occur if the nut has insufficient contact area or has a small volume.

U.S. Pat. No. 4,706,528 discloses an adjustable wrench including a fixed jaw and an adjustable jaw. In an embodiment, a sliding jaw portion is provided on the fixed jaw. The sliding jaw includes a rectilinearly extending slot through which a pin is extended, preventing disengagement of the sliding jaw. A plate spring is mounted to an inner face of the fixed jaw to bias the sliding jaw outward. A hole is formed in an end wall of the slot and receives a coil spring to bias the sliding jaw inward. Thus, the sliding jaw is movable inward or outward and can be retained in place under action of the plate spring and the coil spring. Such a wrench is particularly suitable for rotating pipes, but not suitable for tightening or loosening fasteners such as bolts, nuts, or the like. This is because the sliding jaw can only slide rectilinearly, and the shape of the slot will cause the sliding jaw to slide along the slot to a position pressing against the periphery of the pipe.

U.S. Pat. No. 7,024,971 discloses an open end ratchet wrench including first and second stationary jaws. The first stationary jaw supports a movable plate. A space is sandwiched between two face plates of the first stationary jaw to accommodate the movable plate. The movable plate includes two angled slots each receiving a pin extending through the space, avoiding disengagement of the movable plate. The wrench further includes a hole receiving a spring that has an end located outside of the hole for biasing the movable plate. Each angled slot of the movable plate includes a short section and a long section at an angle to the short section such that the movable plate can move in two stages each having a rectilinear travel. However, the stationary jaw is enclosed by the movable plate such that the contact area between the stationary jaw and the workpiece is significantly decreased. Instead, the supporting effect depends on the larger contact area between the workpiece and the movable plate with structural strength weaker than the fixed jaw. The holding force applied by the open end ratchet wrench is reduced.

U.S. Patent Publication No. US 2009/0301271 A1 discloses an open-ended wrench including a first jaw and a second jaw. The second jaw includes an auxiliary jaw retracting opening that receives an auxiliary jaw. A spring is mounted between an end of the auxiliary jaw and an end wall of the auxiliary jaw retracting opening. The auxiliary jaw includes a limiting slot. An auxiliary jaw limiting member extends from a surface of the second jaw through an opening to the auxiliary jaw retracting opening and is coupled with the limiting slot for confining the auxiliary jaw to move between a first position in which the auxiliary jaw is non-longitudinally biased and a second position in which the auxiliary jaw is longitudinally biased. The auxiliary jaw has an arcuate pushing surface and a driving surface. In use, the wrench can drive a nut in a driving direction to a position and then directly move in a reverse direction about the center of the nut. The auxiliary jaw is compressed by a side of the nut and retracts into the auxiliary retracting opening. Thus, the wrench can be directly rotated in the reverse direction through an angle to a next driving position for driving the nut in the driving direction without the need of disengaging from the nut and reengaging with the nut. However, it is difficult to form the auxiliary jaw retracting opening in the second jaw, which is particularly true for axial drilling. Furthermore, the pushing face and the driving surface of the auxiliary jaw must retract into the auxiliary retracting opening so that the wrench can move in the reverse direction to the next driving position. Thus, the widths of the pushing face and the driving surface must be smaller than the size of the auxiliary jaw retracting opening. However, if the nut is of a smaller thickness or if the nut is moved to a position adjacent to a surface of an object to be tightened such that the width of the side of the nut is smaller than the extent of the pushing face and the driving surface, the pushing face and the driving surface may be worn or damaged due to insufficient contact area with the side of the nut.

FIG. 1 shows a reciprocatable open end wrench 50 including a jaw portion 51 having first and second jaws and defining a wrenching space 52. The second jaw includes a concave arcuate surface having a slot. A swing member 53 is received in the slot. A surface of the swing member 53 faces the second jaw and has an arcuate hollow groove for receiving a spring 54. The concave arcuate surface has a curvature corresponds to that of an arcuate face 532 of the swing member 53. The swing member 53 has a clamping face 531 for contacting with a side of a workpiece 90. The clamping face 531 is planar so as to be in surface contact with the side of the workpiece 90 for driving the workpiece 90. An example of such a wrench is disclosed in U.S. Patent Publication No. US 2010/0071516 A1. However, the diameter D53 of the curvature of the arcuate face 532 is not concentric to the wrenching width S between two parallel sides of the workpiece 90. After the wrench 50 has driven the workpiece 90 to rotate in a driving direction, the rotating arc of the diameter D53 can not allow the wrench 50 to rotate in a reverse direction to the next driving direction. Specifically, the wrench 50 has to be moved backwards through a certain travel so that the arcuate face 531 can slide along the side of the workpiece 90 to the next driving position. If the wrench 50 is directly rotated about the center of the workpiece 90 without the backward travel, the arcuate face 531 will be interfered by a side of the workpiece 90. The driving operation provided by the wrench is not smooth.

Thus, a need exists for an open end wrench capable of fast driving of a workpiece without the disadvantages of the above conventional open end wrenches.

BRIEF SUMMARY OF THE INVENTION

The present invention solves this need and other problems in the field of reliable structural strength of fast drivable open end wrenches by providing, in a preferred form, an open end wrench capable of fast driving a workpiece. The workpiece includes first, second, third, fourth, fifth, and sixth sides respectively having first, second, third, fourth, fifth, and sixth force-receiving faces in a first rotating direction and respectively having first, second, third, fourth, fifth, and sixth force-receiving faces in a second rotating direction. The open end wrench includes a body having a handle and a jaw portion formed on an end of the handle. Spaced first and second jaws are formed on an end of the jaw portion opposite to the handle. The jaw portion further includes an arcuate sliding groove facing the wrenching space. The sliding groove includes spaced, first and second support walls and an arcuate sliding wall extending between the first and second support walls. A guide is fixed in the sliding groove. A slide is slideably received in the sliding groove. The slide includes a first side having an arcuate sliding face slideable along the sliding wall of the sliding groove. The slide further includes a second side opposite to the first side of the slide. The second side of the slide includes a first wrenching face located outside of the sliding groove. The first wrenching face is adapted to correspond to the fourth force-receiving face in the first rotating direction of the workpiece when the slide is in a natural position. The slide further includes a top face and a bottom face. The slide further includes an arcuate guiding slot extending from the top face through the bottom face. The guide is received in the guiding slot, preventing the slide from disengaging from the sliding groove. The guiding slot includes a pressing end. An elastic device has two ends respectively abutting the guide and the pressing end of the guiding slot for biasing the slide to the natural position. The first wrenching face of the slide includes first and second wings extending away from the top and bottom faces of the first wrenching face. The first and second jaws and the first wrenching face and the first and second wings of the slide together define a curvature of a circle having a center located on an axis of the workpiece, allowing the first and second jaws and the first wrenching face and the first and second wings of the slide to rotate about the axis of the workpiece and allowing the first wrenching face and the first and second wings to slide along a circumference of a circumscribed circle of the workpiece without interference. The first and second wings respectively extend towards the first and second support walls and increase a contact area between the first wrenching face of the slide and the fourth force-receiving face in the first rotating direction of the workpiece. A spacing is formed between each of the first and second wings and one of the first and second support walls. The spacings avoid operational interference to sliding movement of the slide in the sliding groove while the first and second jaws and the first wrenching face and the first and second wings of the slide rotate about the axis of the workpiece.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
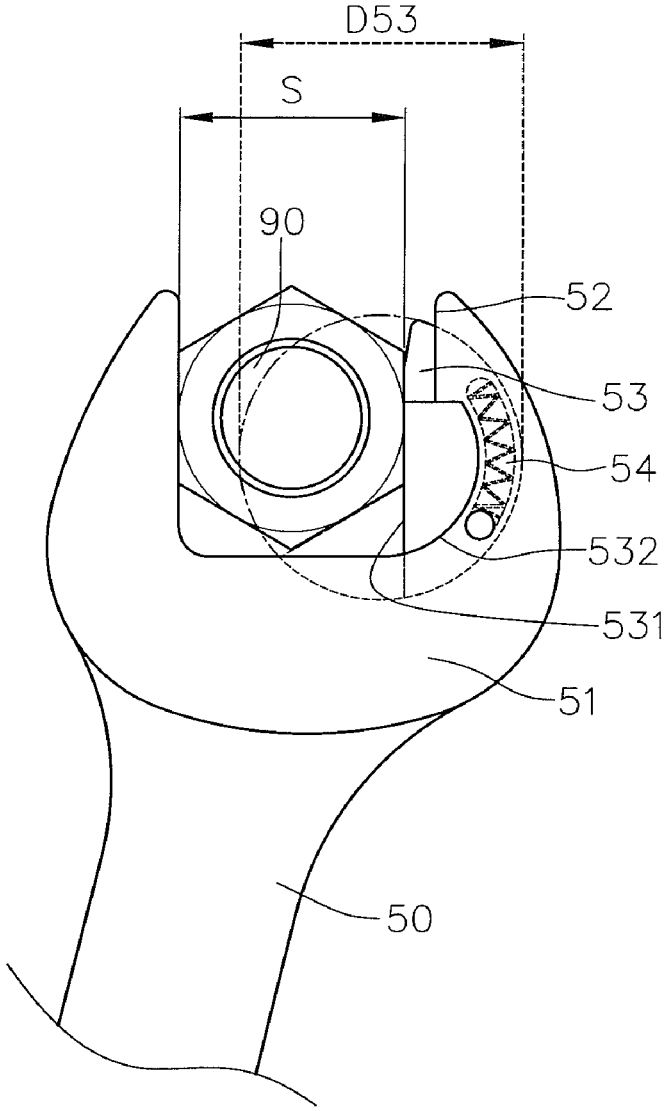
Fig. 1 Prior Art
FIG. 1 shows a partial, top view of a conventional open end wrench.
Figure 2:
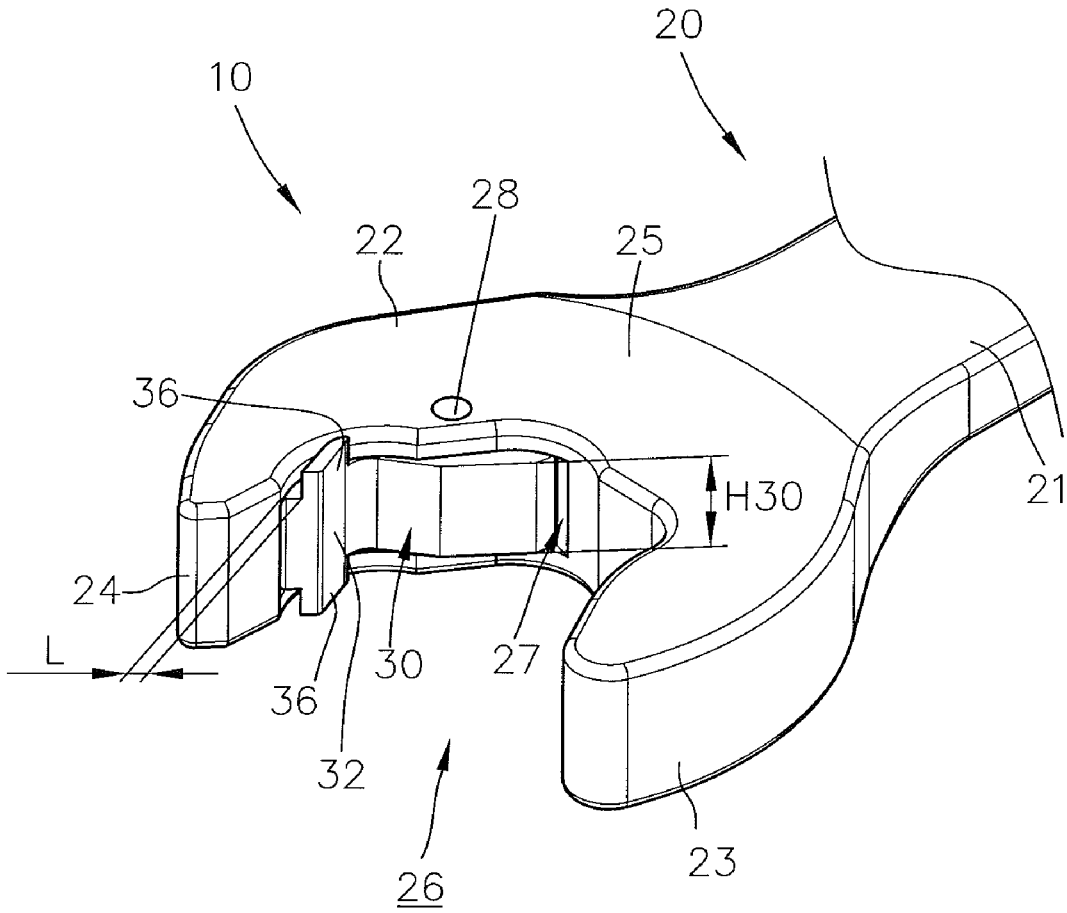
FIG. 2 shows a partial, perspective view of an open end wrench according to the preferred teachings of the present invention.
Figure 3:
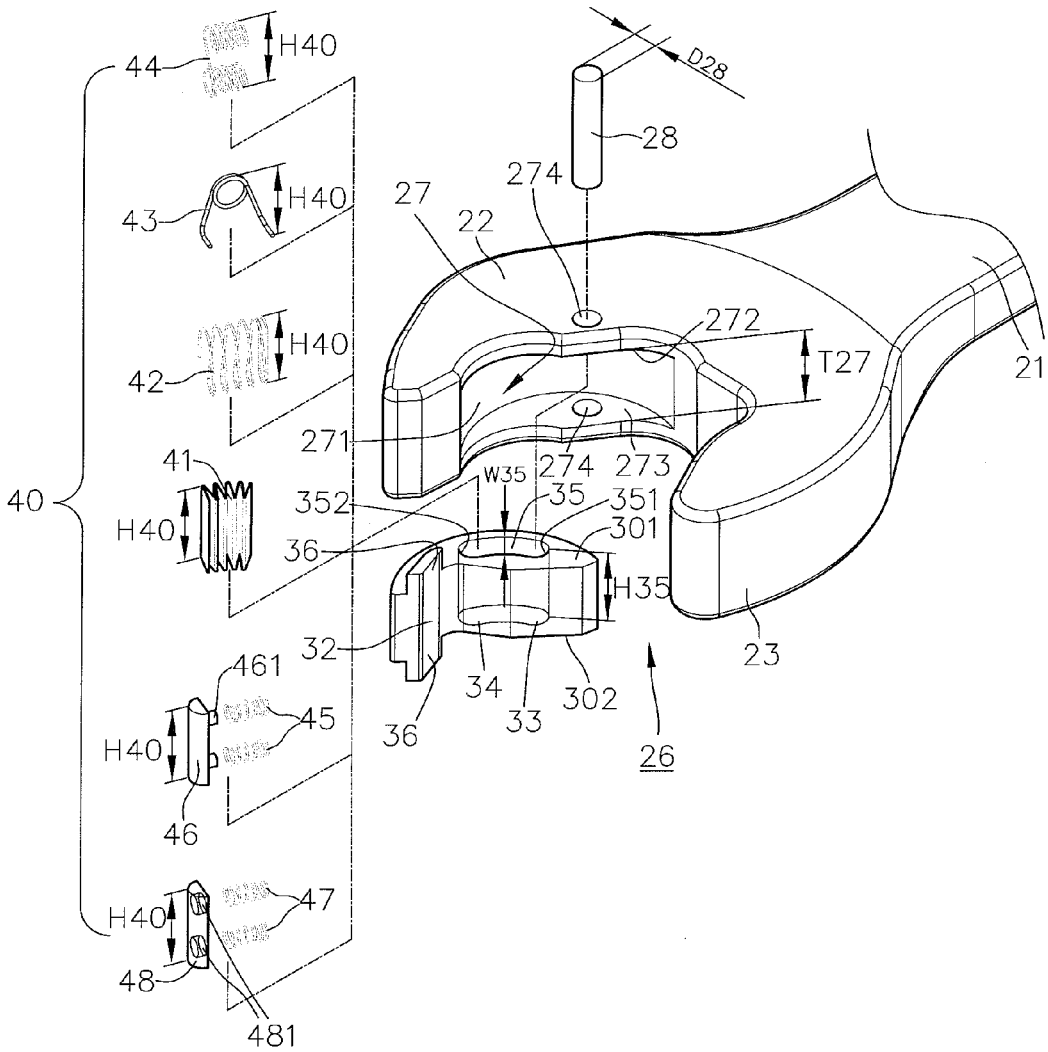
FIG. 3 shows a partial, exploded, perspective view of the open end wrench of FIG. 2.
Figure 4:
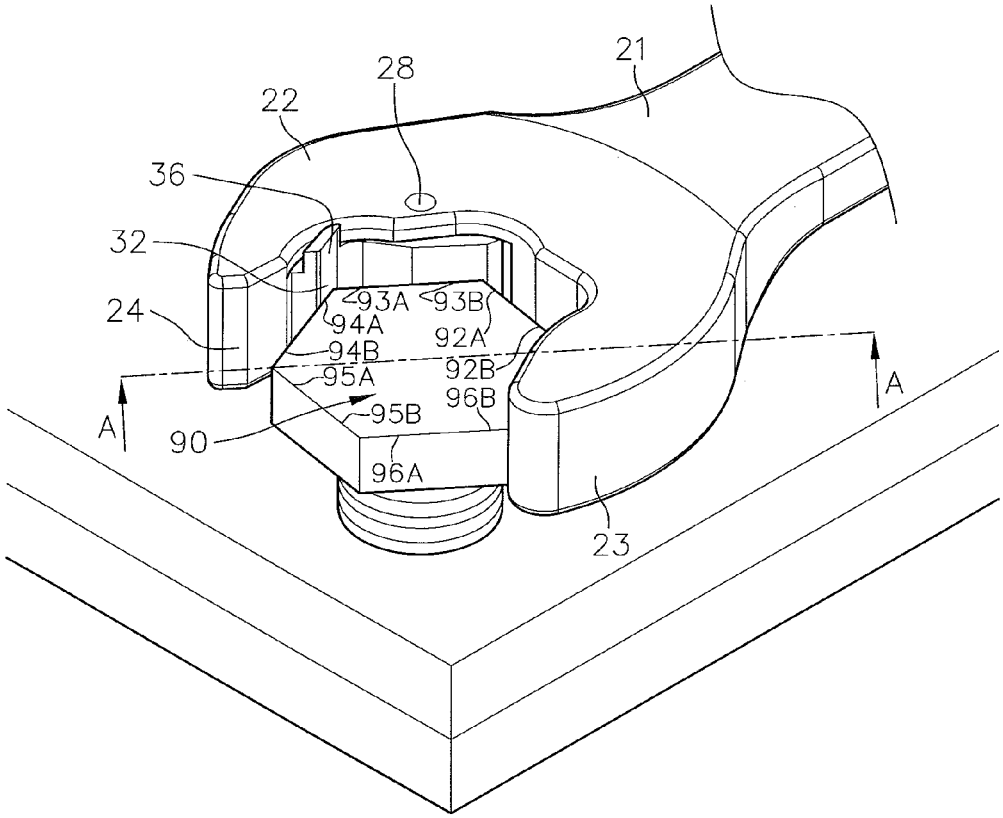
FIG. 4 shows a perspective view illustrating use of the open end wrench of FIG. 2 on a workpiece.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "sixth", "lower", "upper", "inner", "outer", "side", "end", "portion", "section", "spacing", "clockwise", "counterclockwise", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIGS. 2-12 show an open end wrench 10 according to the preferred teachings of the present invention. Open end wrench 10 includes a body 20, a slide 30, and an elastic device 40. Body 20 includes a handle 21 and a jaw portion 22 formed on an end of handle 21. Jaw portion 22 can hold a workpiece 90, such as a hexagonal head of a bolt, a nut, or the like. Workpiece 90 includes first, second, third, fourth, fifth, and sixth sides 91, 92, 93, 94, 95, and 96 respectively having first, second, third, fourth, fifth, and sixth force-receiving faces in a first rotating direction 91A, 92A, 93A, 94A, 95A, and 96A. First, second, third, fourth, fifth, and sixth sides 91, 92, 93, 94, 95, and 96 of workpiece 90 respectively have first, second, third, fourth, fifth, and sixth force-receiving faces in a second rotating direction 91B, 92B, 93B, 94B, 95B, and 96B. A user can grip the handle 21 and rotate body 20 as well as jaw portion 22 about an axis C of workpiece 90 to tighten or loosen workpiece 90.

Spaced first and second jaws 23 and 24 are formed on an end of jaw portion 22 opposite to handle 21. First and second jaws 23 and 24 can withstand reactive force from workpiece 90. First and second jaws 23 and 24 face each other. Furthermore, first and second jaws 23 and 24 and jaw portion 22 are integrally formed as a single and inseparable component of the same material to provide jaw portion 22 with excellent structural strength and to increase the torque bearing capacity of jaw portion 22.

Jaw portion 22 further includes a throat 25 intermediate first and second jaws 23 and 24. Throat 25 and first and second jaws 23 and 24 together define a wrenching space 26. Jaw portion 22 can enter wrenching space 26 by moving jaw portion 22 in a direction perpendicular to one of the six sides of workpiece 90 or by moving jaw portion 22 along axis C of workpiece 90.

First jaw 23 includes a force-applying face 231 facing wrenching space 26 and facing a distal end of second jaw 24. Force-applying face 231 corresponds to first force-receiving face in the first rotating direction 91A of workpiece 90. Second jaw 24 includes first and second faces 241 and 242. First face 241 faces wrenching space 26 and throat 25. Second face 242 faces wrenching space 26 and a distal end of first jaw 23. First face 241 is at an angle of 120° to second face 242 such that first and second faces 241 and 242 correspond respectively to fourth and third force-receiving faces in the first rotating direction 94A and 93A. First face 241 of second jaw 24 is substantially parallel to force-applying face 231 of first jaw 23.

Throat 25 includes a push face 251 facing wrenching space 26. Push face 251 is at an angle of 120° to force-applying face 231 of first jaw 23 such that push face 251 corresponds to second force-receiving face in the first rotating direction 92A. Second face 242 is intermediate first face 241 and push face 251.

Jaw portion 22 further includes a first evasive portion 221 between force-applying face 231 of first jaw 23 and push face 251 of throat 25. First evasive portion 221 can receive first force-receiving face in the second rotating direction 91B of workpiece 90. Jaw portion 22 further includes a second evasive portion 222 between push face 251 of throat 25 and second face 242 of second jaw 24. Second evasive portion 22 can receive second force-receiving face in the second rotating direction 92B of workpiece 90. Furthermore, jaw portion 22 includes a third evasive portion 223 between first and second faces 241 and 242 of the second jaw 24. Third evasive portion 223 can receive third force-receiving face in the second rotating direction 93B of workpiece 90.

An arcuate sliding groove 27 is formed in second jaw 24 and faces wrenching space 26. Sliding groove 27 includes spaced, first and second support walls 272 and 273 and a concave, arcuate sliding wall 271 extending between first and second support walls 272 and 273. Sliding wall 271 is free of holes, grooves, recesses, etc, providing a complete arcuate surface and enhancing the structural strength of second jaw 24. Thus, jaw portion 22 can withstand high-torque operation. Furthermore, a center of an arcuate face of the sliding wall 271 is located in wrenching space 26 such that sliding wall 271 can be easily and rapidly processed with a single cutter at low costs while assuring structural strength of jaw portion 22. First and second support walls 272 and 273 are parallel to each other and have a spacing T27 therebetween.

A circular through-hole 274 is extended through first and second support walls 272 and 273 and in communication with sliding groove 27. Through-hole 274 is located adjacent to throat 25 and receives a cylindrical guide 28 in the form of a pin. Two ends of guide 28 are received in two ends of through-hole 274 in first and second support walls 272 and 273 to retain guide 28 in sliding groove 27. Guide 28 has a diameter D28.

Slide 30 is slideably received in sliding groove 27 and can drive workpiece 90 to rotate in a driving direction or slide along a perimeter of workpiece 90 in an opposite direction opposite to the driving direction without driving workpiece 90. Slide 30 is substantially arcuate in cross section and includes a side having a convex, arcuate sliding face 31 slideably abutting sliding wall 271 of sliding groove 27, allowing relative arcuate sliding movement between slide 30 and jaw portion 22. Sliding face 31 is free of holes, grooves, recesses, etc, providing a complete arcuate surface and enhancing the structural strength of slide 30. Thus, slide 30 can withstand high-torque operation.

Sliding face 31 of slide 30 has a curvature the same as that of sliding wall 271 of sliding groove 27 to allow smooth sliding of sliding face 31 on sliding wall 271. Furthermore, when slide 30 is subjected to reactive force from workpiece 90, the reactive force from the workpiece 90 can be transmitted to sliding wall 271 through a large area of sliding face 31 due to the same curvature. Thus, the force imparted to slide 30 can be distributed, avoiding stress concentration and increasing the torque bearing capacity of slide 30 when workpiece 90 is driven by body 20.

The other side of slide 30 opposite to sliding face 31 is located outside of sliding groove 27 and includes first and second wrenching faces 32 and 33. First and second wrenching faces 32 and 33 are adapted to drive workpiece 90 to rotate. First wrenching face 32 is at an angle of 120° to second wrenching face 33 such that first and second wrenching faces 32 and 33 correspond respectively to fourth and third force-receiving faces in the first rotating direction 94A and 93A of workpiece 90. An evasive portion 34 is formed between first and second wrenching faces 32 and 33 and can receive third force-receiving face in the second rotating direction 93B of workpiece 90.

Slide 30 further includes a top face 301 and a bottom face 302 respectively at upper and lower sides thereof. First and second wrenching faces 32 and 33 extend between top and bottom faces 301 and 302. Top and bottom faces 301 and 302 are parallel to each other and respectively in contact with first and second support walls 272 and 273 of sliding groove 27. Slide 30 has a height H30 between top and bottom faces 301 and 302 in a height direction. Ignoring the tolerance, height H30 of slide 30 is the same as spacing T27 of sliding groove 27. This allows top and bottom faces 301 and 302 of slide 30 to be symmetrically supported by first and second support walls 272 and 273 of sliding groove 27, avoiding wobbling of slide 30 while sliding in sliding groove 27 along an arcuate path and increasing operational stability of open end wrench 10.

Slide 30 further includes a guiding slot 35 extending from top face 301 through bottom face 302. Guiding slot 35 is arcuate in cross section and has a curvature the same as the curvature of sliding wall 271 of sliding groove 27. Since guiding slot 35 extends from top face 301 through bottom face 302, a height H35 of guiding slot 35 in the height direction of slide 30 is the same as height H30 of slide 30. Furthermore, guiding slot 35 has a width W35 (between inner and outer arcuate surfaces thereof) in a width direction perpendicular to the height direction of slide 30. Namely, width W35 is equal to a difference between a radius of the outer arcuate surface and a radius of the inner arcuate surface of guiding slot 35. Ignoring the tolerance, width W35 of guiding slot 35 is the same as diameter D28 of guide 28. Height H35 of guiding slot 35 is larger than 1.5 times width W35 of guiding slot 35 (i.e., width W35 of guiding slot 35 is smaller than 0.66 times height H35 of guiding slot 35. In this embodiment, height H35 of guiding slot 35 is larger than two times width W35 of guiding slot 35 (i.e., width W35 of guiding slot 35 is smaller than 0.5 times height H35 of guiding slot 35).

Guiding slot 35 receives guide 28 to prevent slide 30 from disengaging from sliding groove 27. Since the curvature of sliding face 31 of slide 30 is the same as those of guiding slot 35 and sliding wall 271 of sliding groove 27, smooth sliding movement between guiding slot 35 of slide 30 and guide 28 in sliding groove 27 can be obtained while sliding face 31 of slide 30 is moving along sliding wall 271 of sliding groove 27 along the arcuate path. Undesired interference between slide 30, guide 28, and sliding wall 271 is avoided.

Guiding slot 35 further includes an abutting end 351 and a pressing end 352. When slide 30 is in a natural, initial position not in contact with workpiece 90, abutting end 351 is in contact with guide 28, and pressing end 352 is in contact with elastic device 40. Since all of the surfaces of guiding slot 35 are free of holes, grooves, recesses, etc, stress concentration is avoided, and the structural strength of slide 30 is assured. Thus, slide 30 can withstand high-torque operation. Furthermore, since sliding face 31 and all of the surfaces of guiding slot 35 of slide 30 are free of holes, grooves, recesses, etc, the manufacturing costs of slide 30 can be reduced while providing open end wrench 10 with high-torque capacity and allowing open end wrench 10 to be produced at low costs for wider industrial application.

Elastic device 40 has two ends respectively abutting guide 28 and pressing end 352 of guiding slot 35 for returning slide 30 to its natural, initial position. The elastic member can be of different types and shapes. For example, the elastic member can be a resilient plate 41, a compression spring 42, a torsion spring 43, and a dual compression spring 44. The elastic member has a height H40 not larger than height H35 of guiding slot 35. In another example, elastic device 40 can include a base 46 having two protrusions 461 and two springs 45 each having an end mounted to one of protrusions 461. The overall height of springs 45 are not larger than height H35 of guiding slot 35. In a further example, elastic device 40 can include a base 48 having two receptacles 481 and two springs 47 each having an end received in one of receptacles 481. The overall height of springs 47 are not larger than height H35 of guiding slot 35. Height 40 of the elastic member of elastic device 40 is preferably larger than 0.5 times height H35 of guiding slot 35 such that the elastic member will not rotate in guiding slot 35, assuring returning of slide 30 to the natural position. Detailed structure of these examples of elastic device 40 is disclosed in U.S. patent application Ser. No. 12/881,243 filed Sep. 14, 2010, the entire contents of which are incorporated herein by reference.

Figure 5:
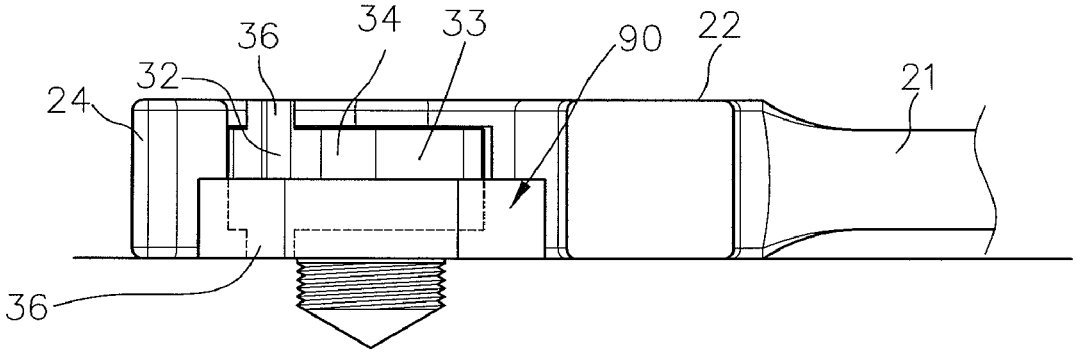
FIG. 5 shows a cross sectional view of the open end wrench and the workpiece of FIG. 4 according to section line A-A of FIG. 4.
Figure 6:
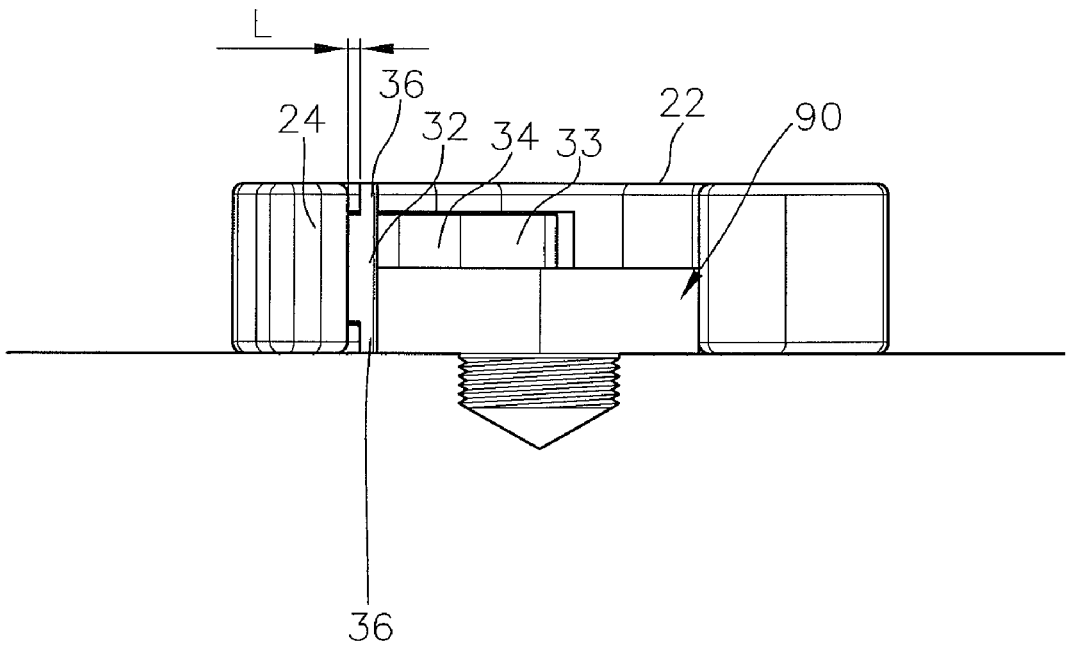
FIG. 6 shows another cross sectional view of the open end wrench and the workpiece of FIG. 4.
Figure 7:
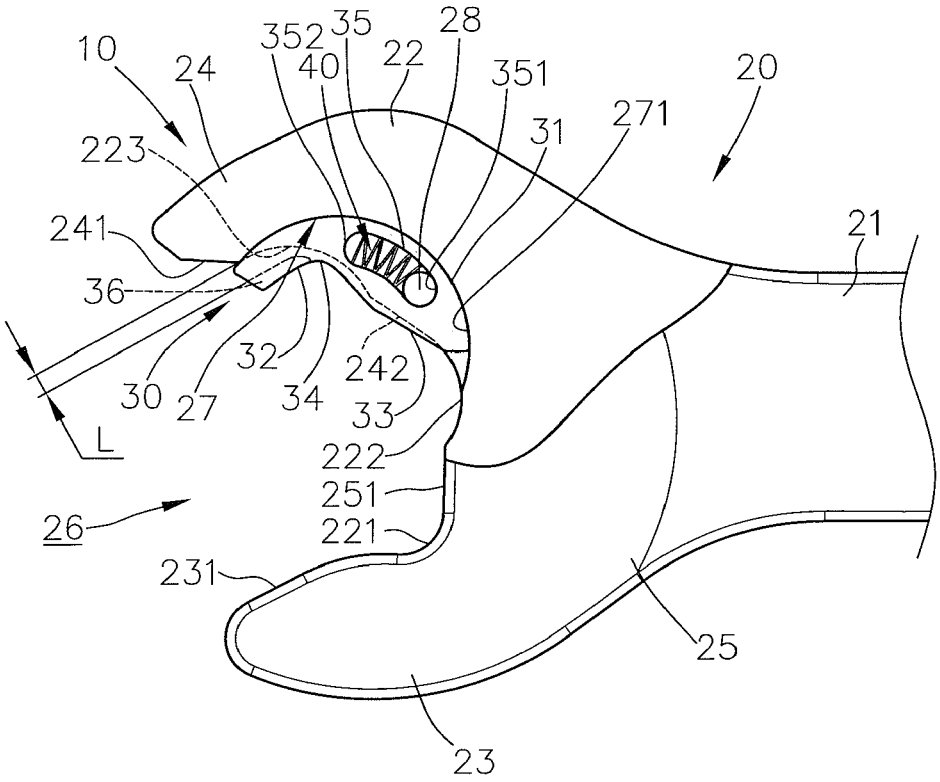
FIG. 7 shows a partial, top view of the open end wrench of FIG. 2.
Figure 8:
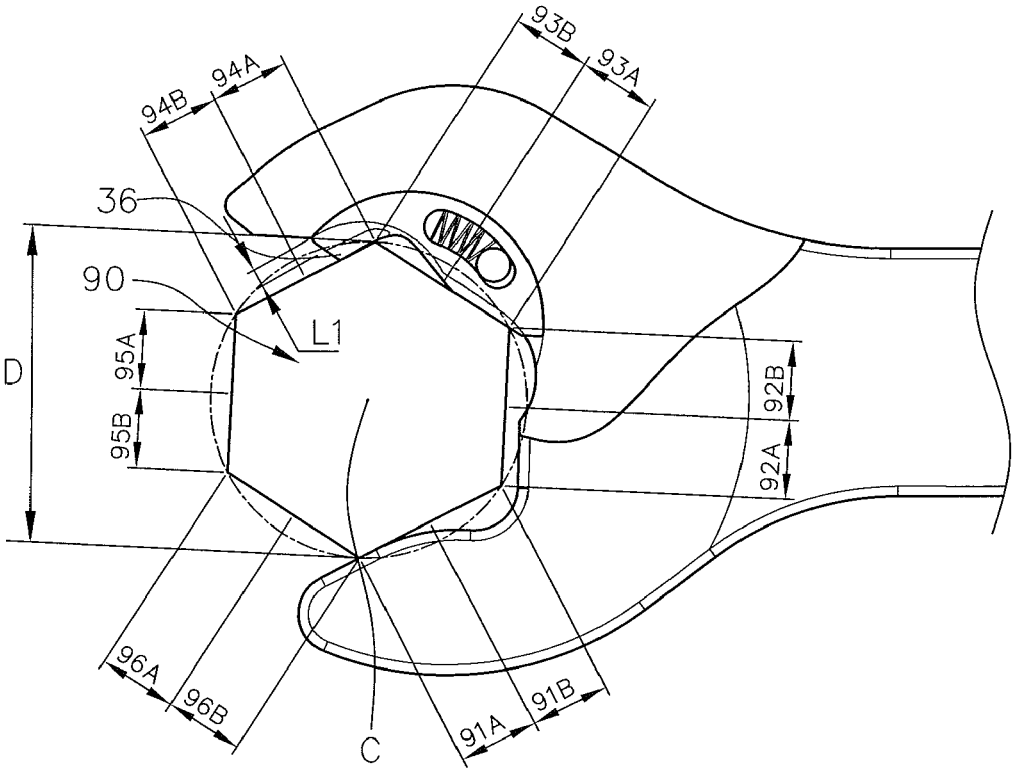
FIG. 8 shows a partial, top view illustrating use of the open end wrench of FIG. 7 on a workpiece.
Figure 9:
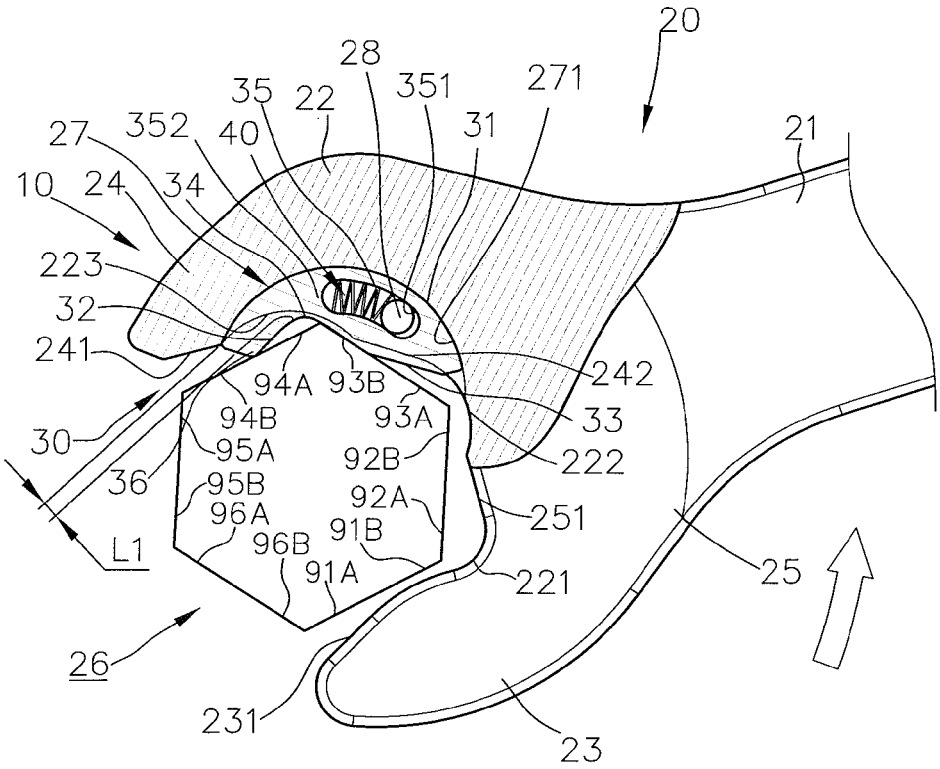
FIG. 9 shows a cross sectional view illustrating rotation of the open end wrench of FIG. 8 in a non-driving direction reverse to a driving direction without driving the workpiece.
Figure 10:
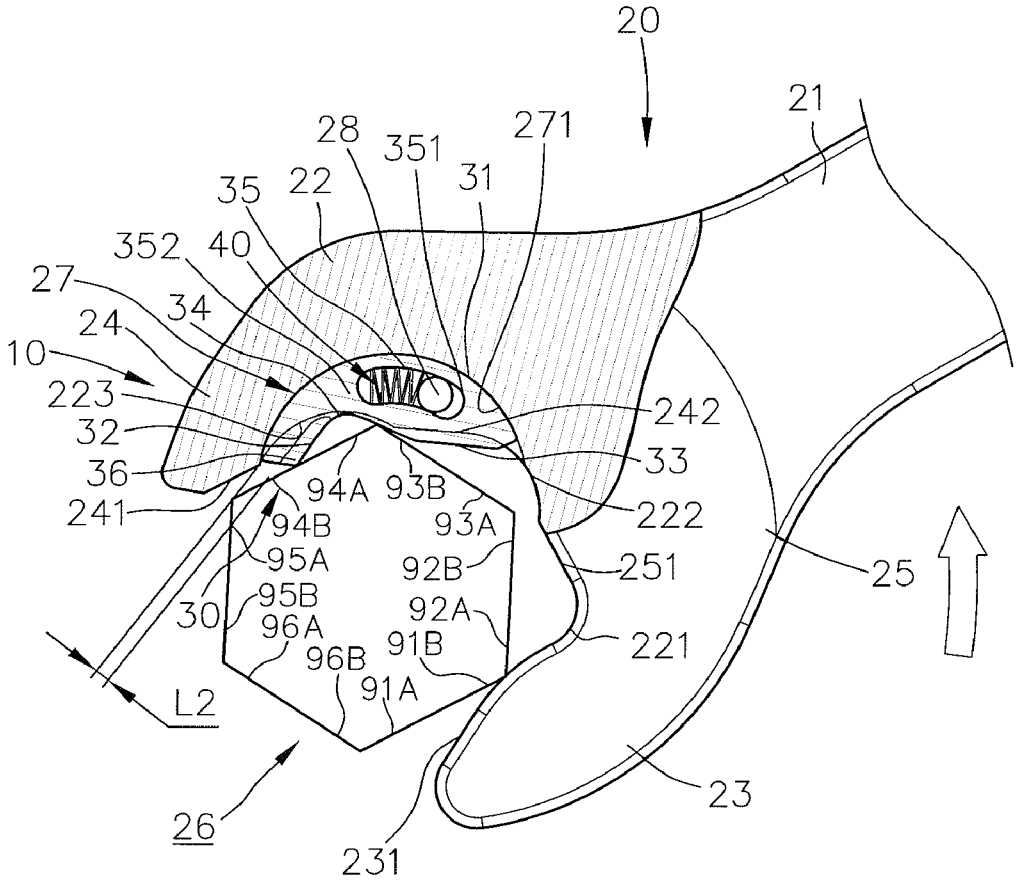
FIG. 10 shows a cross sectional view illustrating further rotation of the open end wrench of FIG. 9 in the non-driving direction.
Figure 11:
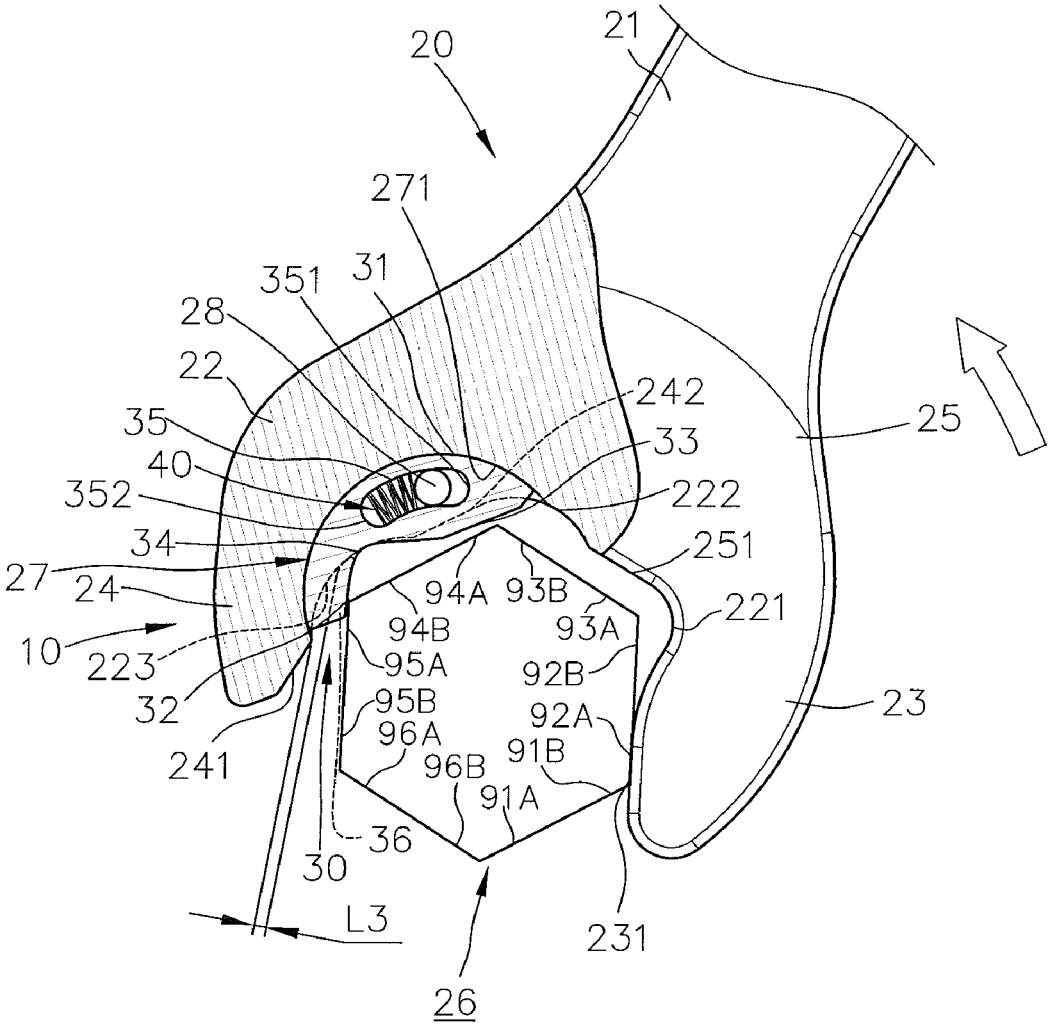
FIG. 11 shows a cross sectional view illustrating further rotation of the open end wrench of FIG. 10 in the non-driving direction.
Figure 12:
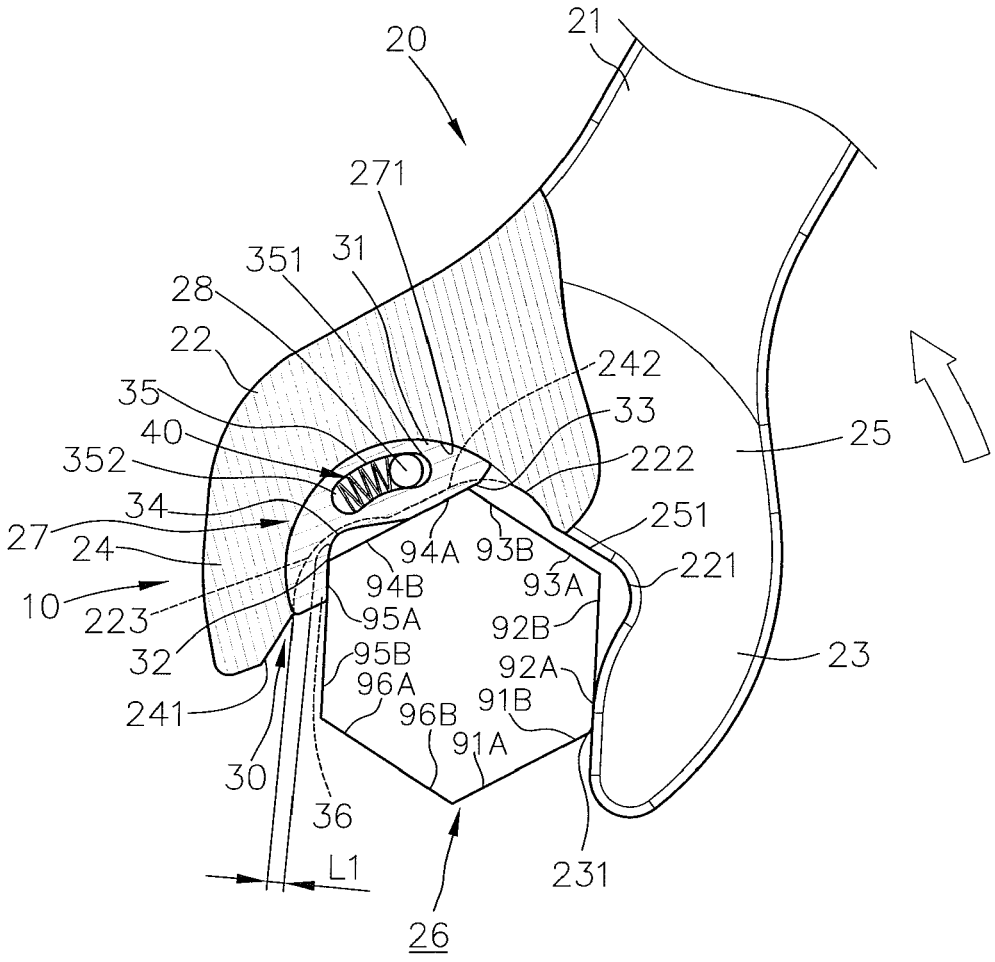
FIG. 12 shows a cross sectional view illustrating further rotation of the open end wrench of FIG. 11 in the non-driving direction.

With reference to FIGS. 5 and 6, the main feature of the present invention is that first wrenching face 32 includes first and second wings 36 extending away from top and bottom faces 301 and 302 of slide 30. When slide 30 is in the natural position, first wrenching face 32 corresponds to fourth force-receiving face in the first rotating direction 94A of workpiece 90. First and second jaws 23 and 24 and first wrenching face 32 and first and second wings 36 of slide 30 together define a curvature of a circle having a center located on axis C of workpiece 90. Thus, first and second jaws 23 and 24 and first wrenching face 32 and first and second wings 36 of slide 30 can rotate about axis C of workpiece 90 during operation. Furthermore, first wrenching face 32 and first and second wings 36 of slide 30 can slide along a circumference of a circumscribed circle of workpiece 90 having a diameter D. After slide 30 is received in sliding groove 27, first and second wings 36 respectively extend towards first and second support walls 272 and 273 to increase the contact area between slide 30 and fourth force-receiving face in the first rotating direction 94A of workpiece 90. First wing 36 is spaced from first support wall 272 by a spacing L.

Open end wrench according to the preferred teachings of the present invention can be used to drive workpiece 90 in a driving direction. Operation of driving workpiece 90 in the driving direction is disclosed in U.S. patent application Ser. No. 12/881,243 filed Sep. 14, 2010, the entire contents of which are incorporated herein by reference.

FIGS. 7-12 show rotation of open end wrench 10 according to the preferred teachings of the present invention in a non-driving direction (indicated by an arrow) reverse to the driving direction without driving workpiece 90. Namely, open end wrench 10 can be moved in the reverse direction back to a position ready for driving workpiece 90 without the need of disengaging workpiece. 90 from wrenching space 26 of jaw portion 22 and subsequent reengaging workpiece 90 in wrenching space 26, allowing fast driving of workpiece 90. Operation of driving workpiece 90 in the non-driving direction is disclosed in U.S. patent application Ser. No. 12/881, 243 filed Sep. 14, 2010, the entire contents of which are incorporated herein by reference.

Spacings L between first and second wings 36 and first and second support walls 272 and 273 vary during rotation of open end wrench 10 in the non-driving direction (see spacings L1, L2, and L3 in FIGS. 8-12). Spacings L avoid operational interference to sliding movement of slide 30 in sliding groove 27 while first and second jaws 23 and 24 and first wrenching face 32 and first and second wings 36 of slide 30 rotate about axis C of workpiece 90.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open end wrench (10) capable of fast driving a workpiece (90), with the workpiece (90) including first, second, third, fourth, fifth, and sixth sides respectively having first, second, third, fourth, fifth, and sixth faces in a first rotating direction (91A, 92A, 93A, 94A, 95A, 96A) and respectively having first, second, third, fourth, fifth, and sixth force-receiving faces in a second rotating direction (91B, 92B, 93B, 94B, 95B, and 96B), with the open end wrench (10) comprising, in combination:

a body (20) including a handle (21) and a jaw portion (22) formed on an end of the handle (21), with spaced first and second jaws (23, 24) formed on an end of the jaw portion (22) opposite to the handle (21), with the jaw portion (22) further including an arcuate sliding groove (27) facing the wrenching space (26), with the sliding groove (27) including spaced, first and second support walls (272, 273) and an arcuate sliding wall (271) extending between the first and second support walls (272, 273), with a guide (28) fixed in the sliding groove (27);

a slide (30) slideably received in the sliding groove (27), with the slide (30) including a first side having an arcuate sliding face (31) slideable along the sliding wall (272) of the sliding groove (27), with the slide (30) further including a second side opposite to the first side of the slide (30), with the second side of the slide (30) including a first wrenching face (32) located outside of the sliding groove (27), with the first wrenching face (32) adapted to correspond to the fourth force-receiving face in the first rotating direction (94A) of the workpiece (90) when the slide (30) is in a natural position, with the slide (30) further including a top face (301) and a bottom face (302), with the slide (30) further including an arcuate guiding slot (35) extending from the top face (301) through the bottom face (302), with the guide (28) received in the guiding slot (35), preventing the slide (30) from disengaging from the sliding groove (27), with the guiding slot (35) including a pressing end (352); and an elastic device (40) having two ends respectively abutting the guide (28) and the pressing end (352) of the guiding slot (35) for biasing the slide (30) to the natural position, the first wrenching face (32) of the slide (30) including first and second wings (36) extending away from the top and bottom faces (301, 302) of the first wrenching face (32), the first and second jaws (23, 24) and the first wrenching face (32) and the first and second wings (36) of the slide (30) together define a curvature of a circle having a center located on an axis (C) of the workpiece (90), allowing the first and second jaws (23, 24) and the first wrenching face (32) and the first and second wings (36) of the slide (30) to rotate about the axis (C) of the workpiece (90) and allowing the first wrenching face (32) and the first and second wings (36) to slide along a circumference of a circumscribed circle of the workpiece (90) without interference, with the first and second wings (36) respectively extending towards the first and second support walls (272, 273) and increasing a contact area between the first wrenching face (32) of the slide (30) and the fourth force-receiving face in the first rotating direction (94A) of the workpiece (90), with a spacing (L) formed between each of the first and second wings (36) and one of the first and second support walls (272, 273), with the spacings (L) avoiding operational interference to sliding movement of the slide (30) in the sliding groove (27) while the first and second jaws (23, 24) and the first wrenching face (32) and the first and second wings (36) of the slide (30) rotate about the axis (C) of the workpiece (90).

2. The open end wrench as claimed in claim 1, with the jaw portion (22) including a throat (25) intermediate the first and second jaws (23, 24), with the throat (25) and the first and second jaws (23, 24) together defining a wrenching space (26) adapted for receiving the workpiece (90), with the first jaw (23) including a force-applying face (231) facing the wrenching space (26) and facing a distal end of the second jaw (24), with the force-applying face (231) adapted to correspond to the first force-receiving face in the first rotating direction (91A) of the workpiece (90).

3. The open end wrench as claimed in claim 1, with the guide (28) having two ends fixed to the first and second support walls (272, 273).

4. The open end wrench as claimed in claim 1, with the guiding slot (35) including an abutting end (351), with the abutting end (351) being in contact with the guide (28) when the slide (30) is in an initial position not engaged with the workpiece (90).

5. The open end wrench as claimed in claim 1, with the slide (30) further including a second wrenching face (33) at an angle of 120° to the first wrenching face (32), with the second wrenching face (33) adapted to correspond to the third force-receiving face in the first rotating direction (93A) of the workpiece (90).

6. The open end wrench as claimed in claim 5, with the slide (30) further including an evasive portion (34) between the first and second wrenching faces (32, 33), with the evasive portion (34) of the slide (30) adapted to allow entrance of the third force-receiving face in the second rotating direction (93B) of the workpiece (90).

7. The open end wrench as claimed in claim 1, with the sliding face (31) of the slide (30) having a first curvature, with the sliding wall (271) of the sliding groove (27) having a second curvature equal to the first curvature, with the sliding face (31) of the slide (30) smoothly slideable along the sliding wall (271) of the sliding groove (27), with the sliding face (31) adapted to transmit reactive force from the workpiece (90) to the sliding wall (271) and to avoid concentration of stress on the slide (30), increasing torque bearing capacity of the slide (30) when the workpiece (90) is driven by the body (20) to rotate.

8. The open end wrench as claimed in claim 7, with the guiding slot (35) having a third curvature equal to the second curvature, allowing relative smooth, arcuate sliding between the guiding groove (35) of the slide (30) and the guide (28) in the sliding groove (27) without operational interference therebetween.

9. The open end wrench as claimed in claim 1, with the top face (301) of the slide (30) in sliding contact with the first support wall (272) of the sliding groove (27), with the bottom face (302) of the slide (30) in sliding contact with the second support wall (273) of the sliding groove (27), with the top and bottom faces (301, 302) symmetrically supported by the first and second support walls (272, 273).

10. The open end wrench as claimed in claim 1, with the first and second jaws (23, 24) and the jaw portion (22) integrally formed as a single and inseparable component of a same material.

11. The open end wrench as claimed in claim 1, with the throat (25) including a push face (251) facing the wrenching space (26), with the push face (251) at an angle of 120° to the force-applying face (231) of the first jaw (23), with the push face (251) of the throat (25) adapted to correspond to the second force-receiving face in the first rotating direction (92A) of the workpiece (90).

12. The open end wrench as claimed in claim 11, with the second jaw (24) including first and second faces (241, 242), with the first face (241) of the second jaw (24) facing the wrenching space (26) and the throat (25), with the second face (242) of the second jaw (24) facing the wrenching space (26) and a distal end of the first jaw (23), with the first face (241) of the second jaw (24) at an angle of 120° to the second face (242) of the second jaw (24), with the first and second faces (241, 242) adapted to correspond respectively to the fourth and third force-receiving faces in the first rotating direction (94A, 93A) of the workpiece (90), with the first face (241) of the second jaw (24) parallel to the force-applying face (231) of the first jaw (23), with a first evasive portion (221) formed between the force-applying face (231) of the first jaw (23) and the push face (251) of the throat (25), with the first evasive portion (221) adapted to allow entrance of the first force-receiving face in the second rotating direction (91B) of the workpiece (90), with a second evasive portion (222) formed between the push face (251) of the throat (25) and the second face (242) of the second jaw (24), with the first evasive portion (221) adapted to allow entrance of the second force-receiving face in the second rotating direction (92B) of the workpiece (90), with the jaw portion (22) further including a third evasive portion (223) between first and second faces (241, 242) of the second jaw (24), with third evasive portion (223) adapted to allow entrance of the third force-receiving face in the second rotating direction (93B) of workpiece (90).

13. The open end wrench as claimed in claim 1, with the elastic device (40) including an elastic element (41, 42, 43, 44, 45, 47) received in the guiding slot (35) of the slide (30), with the first and second support walls (272, 273) of the sliding groove (27) parallel to each other and having a spacing (T27) therebetween, with the top and bottom faces (301, 302) of the slide (30) parallel to each other and having a height (H30) in a height direction of the slide (30) equal to the spacing (T27), with the guiding slot (35) of the slide (30) having a height (35) in the height direction of the slide (30) equal to the height (H30) of the slide (30), with the guiding slot (35) having a width (W35) in a width direction perpendicular to the height direction of the guiding slot (35), with the width (W35) of the guiding slot (35) equal to a diameter (D28) of the guide (28), with the height (H35) of the guiding slot (35) larger than 1.5 times the width (W35) of the guiding slot (35), with the elastic element (41, 42, 43, 44, 45, 47) received in the guiding slot (35) having a height (H40) in the height direction of the slide (30) not larger than the height (H35) of the guiding slot (35), with the height (H40) of the elastic element (41, 42, 43, 44, 45, 47) larger than the width (W35) of the guiding slot (35).

* * * * *